US006749108B2

(12) United States Patent
Naughton et al.

(10) Patent No.: US 6,749,108 B2
(45) Date of Patent: Jun. 15, 2004

(54) BOX CONTAINER WITH PROTECTIVE BEAM SUPPORT

(75) Inventors: William J. Naughton, Olive Brach, MS (US); Benjamin W. Quaintance, Germantown, TN (US); Pamela J. Riggins, Bartlett, TN (US); Brian D. Smith, Collierville, TN (US); Donald A. Leith, Cranston, RI (US)

(73) Assignee: International Paper Company, Stamford, CT (US)

( * ) Notice: Subject to any disclaimer, the term of this patent is extended or adjusted under 35 U.S.C. 154(b) by 0 days.

(21) Appl. No.: 10/369,041

(22) Filed: Feb. 18, 2003

(65) Prior Publication Data

US 2003/0173396 A1 Sep. 18, 2003

Related U.S. Application Data

(60) Provisional application No. 60/394,754, filed on Jul. 10, 2002, and provisional application No. 60/357,488, filed on Feb. 15, 2002.

(51) Int. Cl.[7] ..... B65D 21/032

(52) U.S. Cl. ..... 229/199; 206/509; 229/915

(58) Field of Search ..... 229/199, 199.1, 229/915, 919; 206/509, 280, 289, 290, 291; 220/652, 653

(56) References Cited

U.S. PATENT DOCUMENTS

| | | | | |
|---|---|---|---|---|
| 1,657,515 A | | 1/1928 | Miller | |
| 1,664,308 A | | 3/1928 | Miller | |
| 1,706,804 A | | 3/1929 | Miller | |
| 1,754,183 A | | 4/1930 | Wildberg | |
| 1,876,063 A | | 10/1932 | Kronenberger | |
| 1,940,010 A | | 12/1933 | Murray | |
| 1,973,930 A | | 9/1934 | Rammer | |
| 2,014,695 A | | 9/1935 | Peterson | |
| 2,122,654 A | * | 7/1938 | Nickerson | 229/199 |
| 2,200,867 A | | 5/1940 | Weltmer | |
| 2,250,746 A | * | 7/1941 | Burr | 229/199.1 |
| 2,253,428 A | * | 8/1941 | Henderson | 229/199 |
| 2,367,491 A | * | 1/1945 | Ferguson | 229/199 |
| 2,483,481 A | | 10/1949 | Stetson | |
| 2,759,619 A | | 8/1956 | Barbour | |
| 2,844,299 A | | 7/1958 | Kessler et al. | |
| 2,969,170 A | | 1/1961 | Waldorf | |
| 3,097,781 A | | 7/1963 | Masi | |
| 3,107,041 A | * | 10/1963 | Wagner, Jr. | 229/919 |
| 3,159,326 A | | 12/1964 | Stonebanks | |
| 3,493,101 A | * | 2/1970 | Collin | 229/199 |
| 3,519,190 A | | 7/1970 | Acherman et al. | |
| 3,536,246 A | | 10/1970 | Rosen | |
| 3,800,960 A | * | 4/1974 | Collin | 206/289 |
| 3,910,411 A | | 10/1975 | Deeren | |
| 3,934,790 A | | 1/1976 | Easter | |
| 3,946,935 A | * | 3/1976 | Bonczyk | 229/199 |
| 3,993,239 A | | 11/1976 | Exel | |
| 4,081,124 A | | 3/1978 | Hall | |
| 4,160,519 A | | 7/1979 | Gorham | |
| 4,293,076 A | * | 10/1981 | Collin | 206/289 |
| 4,341,338 A | | 7/1982 | Arnold | |
| 4,498,584 A | | 2/1985 | Newbury | |
| 4,663,207 A | | 5/1987 | Kupersmit | |
| 4,757,938 A | * | 7/1988 | Collins | 229/199 |
| 4,828,894 A | * | 5/1989 | Taylor | 229/199 |
| 4,948,033 A | | 8/1990 | Halsell, II | |
| 4,984,690 A | | 1/1991 | King et al. | |
| 5,143,283 A | | 9/1992 | Lancaster | |
| 5,261,594 A | | 11/1993 | Brown et al. | |
| 5,285,956 A | | 2/1994 | Piepho | |

(List continued on next page.)

*Primary Examiner*—Gary E. Elkins
(74) *Attorney, Agent, or Firm*—Dennis H. Lambert

(57) ABSTRACT

A container for carrying produce is reinforced with at least one cross beam extending longitudinally across the upper side of the container and supported by the container's side walls. The cross beam is supported by die cut recesses in the upper edge of opposing side walls or by extensions extending from the sides of the cross beam.

22 Claims, 8 Drawing Sheets

U.S. PATENT DOCUMENTS 5,372,299 A 12/1994 Edgerton, Jr. et al.
5,450,998 A 9/1995 Esse et al.
5,538,130 A 7/1996 Harrelson
5,638,983 A 6/1997 Bazany
5,687,902 A 11/1997 Tusing et al.
5,749,513 A 5/1998 Strauser
5,871,148 A 2/1999 Hafer et al.
5,988,492 A 11/1999 Capy et al.
6,062,469 A 5/2000 Hafer et al.
6,129,267 A 10/2000 Hafer et al.

* cited by examiner

BOX CONTAINER WITH PROTECTIVE BEAM SUPPORT

RELATED APPLICATION

This application claims priority from Provisional Application Serial No. 60/394,754, filed Jul. 10, 2002 and Provisional Serial No. 60/357,488, filed Feb. 15, 2002.

FIELD OF THE INVENTION

The present invention relates to a reinforced container, erected from a unitary paperboard blank, for the holding, stacking and transporting of items such as agricultural produce. In particular, the present invention relates to a reinforced container having a beam or other rigid structure that extends longitudinally across the upper portion of the container and is supported by the container's side walls.

BACKGROUND OF THE INVENTION

Corrugated paperboard is typically used in many different applications, for example, to form containers, boxes, cartons, or dividers for holding, storing, stacking or shipping various items such as agricultural produce.

Typically, such containers have a bottom and four side walls, and are formed from a blank scored with score lines or cut lines. The blanks are most often formed by automated machines in a continuous in-line process involving cutting, scoring and molding continuous sheets of paperboard. The paperboard is then folded along the score lines or cut lines to form a container. The blanks may be folded into a container by an automated machine or by a consumer. A removable top may be placed securely onto the container, although it is not required for normal usage, such as shipping, stacking or displaying.

During use, containers are often stacked on top of one another, causing vertical stress on the containers in the stack. In these circumstances, it is possible that insufficient strength of the container's bottom or removable top causes the bottom or top to bow under the pressure of stacking. Thus, containers must have sufficient strength to withstand the wear and tear of constant shipping and stacking, particularly to avoid damage to the produce contained therein. To remedy this, the erected paperboard containers are sometimes reinforced with additional structures to better protect the items held within. Such reinforcement structures often take the form of a latticework of beams and supports that are inserted within the container. These supports, however, limit the space of the interior of the container and require excessive amounts of additional material. Other reinforcement structures take the form of beams or ridges that are integrally formed to the container's side or bottom walls, or to an interior lining. These reinforcements similarly impede the containers lateral space and are not easily removed when the container is filled.

Other reinforced containers have beams or other rigid structures that extend over the upper portion of the container. This is particularly important in containers that are especially short and wide, wherein the removable top bears an undue amount of stress. However, upper portion reinforcements are usually bonded to the lid and do not come in significant contact with the side walls, lessening the strength of the container's reinforcement system.

Therefore, it is an object of this invention to provide a paperboard container with a reinforcement structure that does not unduly impede the container's volume, is easily removable, yet supported by the side walls of the container for additional reinforcement.

SUMMARY OF THE INVENTION

The present invention comprises a container having a reinforcing beam or other rigid structure that extends longitudinally across the upper portion of the box and is supported by the packages side walls, increasing the strength of the box while being easily removable to improve the display and access of the items held within the container.

The container may be any corrugated box of the type often used for transporting food items, with a bottom side, two opposing side walls, two opposing end walls and a removable lid. A cross beam or other rigid structure extends longitudinally across the upper portions of the container and is supported by the two opposing side walls.

One embodiment of the invention includes a cross beam constructed of any rigid material such as wood, corrugated paper, paper wound posts, plastic metal or a composite material, placed laterally across the container and secured by die cut recesses in the top edges of the opposing side walls of the container. The container's side walls may contain multiple die cut recesses, and as a result, the container may have more than one cross beam. Additionally, the cross beam may be affixed to the container's removable lid.

The beam or other rigid structure may be various shapes and sizes to provide maximum use of the container's interior space. In one embodiment, the beam has a substantially round shape with a flat top surface for contacting an inner surface of the removable lid, and a bottom surface having a longitudinal depression extending the length of the beam, structurally strengthening the beam.

Other embodiments include beams or other rigid structures with flat extensions extending out of the beam's top surface. The extensions rest on the top side of the container's two opposing side walls. In this embodiment, the container is not required to have die cut recesses.

Other objects, embodiments, features and advantages of the present invention will be apparent when the description of a preferred embodiment of the invention is considered in conjunction with the annexed drawings, which should be construed in an illustrative and not limiting sense.

BRIEF DESCRIPTION OF THE FIGURES/ DRAWINGS

DETAILED DESCRIPTION

Figure 1:
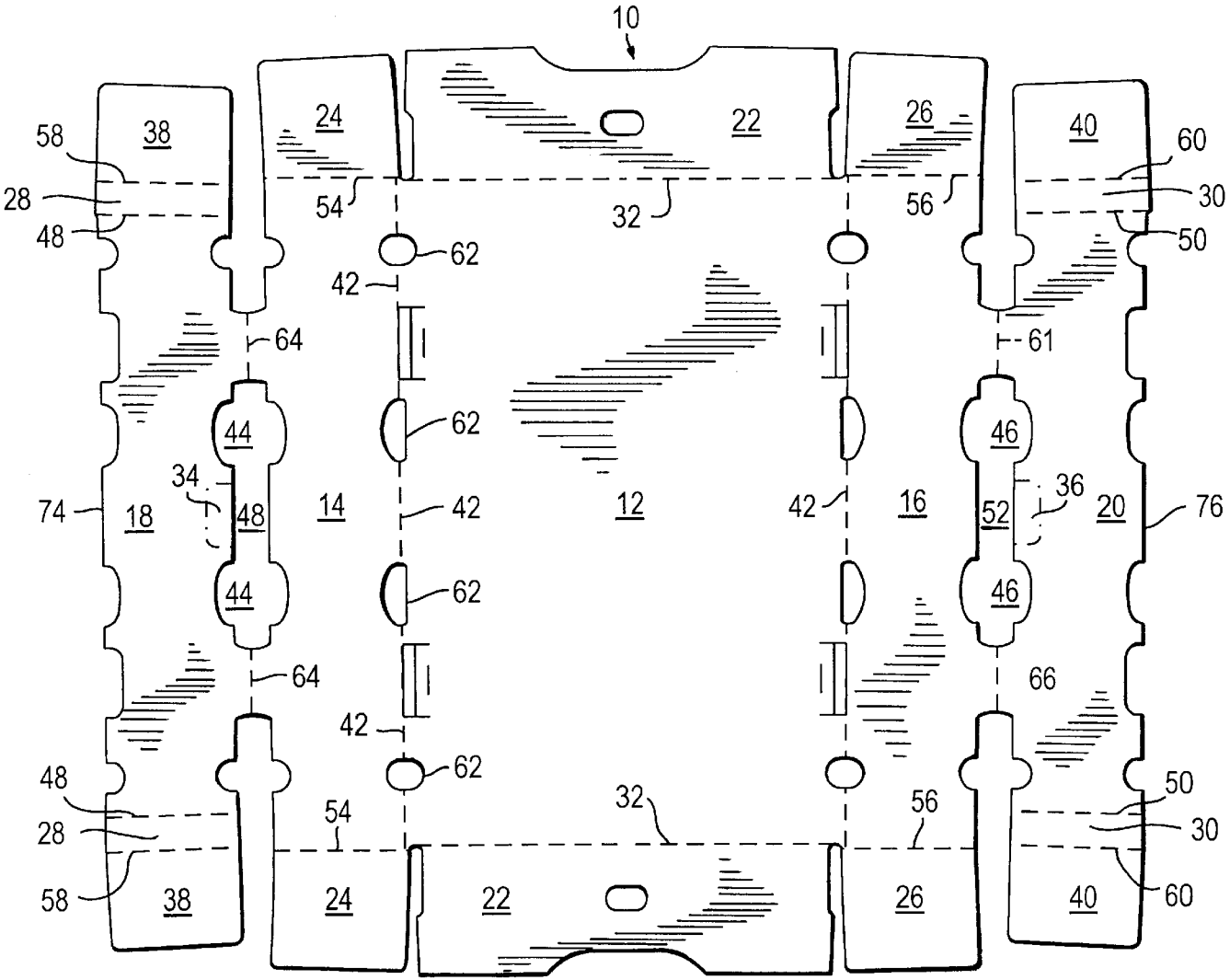
FIG. 1 is a plan view of a paperboard blank that may be used to form a container.

A paper or paperboard blank scored in accordance with one embodiment of the invention is shown in FIG. 1. Blank 10 is scored for the purpose of folding into a container suitable for holding, shipping or stacking a wide variety of objects, such as perishable agricultural products. The blank is preferably a flat corrugated paper or paperboard made of any material known that is suitable for the shipping and transporting a wide variety of food items. For example, if one were to package heavier materials, a thicker grade may be advisable. Further, the strength of the paper or paperboard can be increased by having a thickness of more than one ply (multi-ply paperboard).

Bottom panel 12 is a substantially rectangular panel bordered by end fold lines 32 and side fold lines 42. End panels 22 foldably connect to bottom panel 12 along fold lines 32, and first and second outer side panels 14 and 16 foldably attach to bottom panel 12 along fold lines 42. Holes 62 are provided alongside fold lines 42 to provide breathing holes and access for an automated machine to manipulate and fold the blank into a fully erect container.

First outer side panel 14 is a generally rectangular piece that corresponds to the outer layer of the side wall when the container is fully erected. Accordingly, the width of the outer side panel 14 in blank 10 corresponds to the height of the side panel 70 on an erected container 68 in FIG. 3. The first outer side panel 14 is bordered on four sides by an upper side fold lines 64, a lower side fold line 42, and two end fold lines 54. End flaps 24 foldably attach to outer side panel 14 along fold lines 54.

First interior side panel 18 is a generally rectangular piece of similar length and width as outer side panel 14. When the blank is erected, the interior side panel will become the inner layer of the side wall 70 in FIG. 3, lying flush against outer side panel 14. Panel 18 shares upper fold line 64 with first outer side panel 14, and is bordered on four sides by the upper fold line 64, a lower edge 74, and two end fold lines 48. On the panel's ends, first corner flaps 28 foldably attach to outer side panel 18 along fold lines 48, and second corner flaps 38 foldable attach to first corner flaps 28 along fold lines 58. The first and second corner flaps provide reinforcement for the container's corner when the container is erected. The interior panel may also contain breathing holes 44.

A die cut panel 34 is scored in the upper side of panel 18, bordering open void 48. The panel can be removed, revealing a recess that corresponds to a die cut recess on the erected container, and can be of any shape or size suitable for supporting a beam. Alternatively, the panel can fold outward while remaining attached to panel 18 along the recess's lower edge, forming a recess and a beam support directly under the recess.

Second outer side panel 16 and interior panel 20 are configured and function the same as panels 14 and 18, respectively, including a die cut panel 36 scored in the upper side of panel 20.

Figure 2:
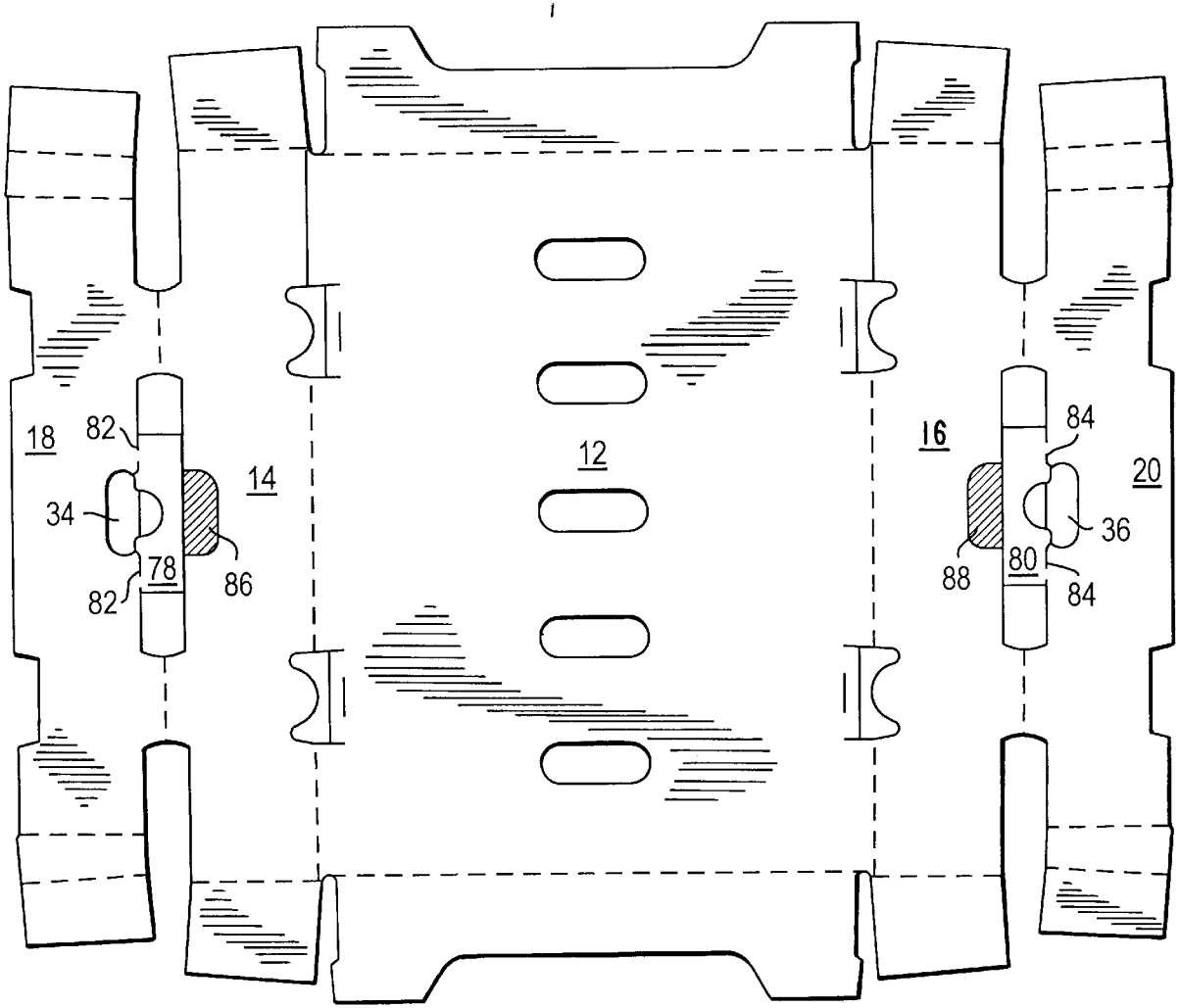
FIG. 2 is a plan view of an alternate embodiment of a paperboard blank for forming a container.

In alternate embodiments, as shown in FIG. 2, alternate blank 108 has cover flaps 78 and 80 foldably attached to outer side panels 14 and 16 that, when the container is erected, can pivot and cover a cross beam, holding it secure. Each cover flap is preferably substantially rectangular in shape and foldably attached to outer side panels along fold lines 82 and 84. The exact shape and size of the cover flap can vary, however, as long as it sufficiently covers the beam and holds it secure.

Additionally, outer side panels 14 and 16 blank may further include crushed areas 86 and 88, respectively, substantially identical in size and shape to die cut panels 34 and 36. The crushed areas are portions of the blank that are compressed, resulting in a paperboard thickness less than the non-crushed portions of the paperboard. When the container is erected, the crushed areas decrease the amount of paperboard, thereby increasing the thickness of the recess, providing more support for the beam. The crushed areas can border open voids 48 and 52 (in FIG. 1) or cover flaps 78 and 80 (in FIG. 2), directly opposite die cut panels 34 and 36. Alternatively, outer side panels 14 and 16 may include supplementary die cut voids in place of the crushed areas 86 and 88. The supplementary die cut voids are in the same location as the crushed areas and are substantially identical in size and shape to the panels.

The container is preferably folded and erected by a machine in a continuous in-line process. For example, the container blank 10 of FIG. 1 is first folded along fold lines 42, lifting outer side panels 14 and 16 and interior side panels 18 and 20 upwards, out of the horizontal plane of base panel 12.

Interior panels 18 and 20 then fold downward, towards base panel 12, along upper fold lines 64 and 66, respectively. The interior panels fold 180 degrees until they lie flush against the outer panels in a face-to-face configuration. The outer and interior panels adhere together with any adhesive known in the art for adhering panels of corrugated paper. As a result, the interior panels and outer panels combine to form side walls 70 and 72. Side wall 70 corresponds to outer panel 14 bonded to interior panel 18. Side wall 72 corresponds to outer panel 16 bonded to interior panel 20.

After the interior side panels are folded over the outer side panels, end flaps 24 and 26 are folded inwardly toward the base panel along fold lines 54 and 56. Further, corner flaps 28, 30, 38 and 40 fold inwardly, toward the base panel along fold lines 48, 50, 58 and 60, respectively. End panels 22 are then folded upwards, out of the horizontal plane of base panel 12, creating end walls 90 and 92. The corner flaps, end flaps and end walls are adhered together with any adhesive known in the art for adhering panels of corrugated paper, strengthening the container's structure. As a result of the combination of the end panels, the end flaps, and the corner flaps, the erected container has three layers along the sides of each of the ends walls.

In additional embodiments, cover flaps 78 and 80 may extend from outer flaps 14 and 16 and pivot downward along the outer flaps' top edges. The cover flaps cover the top sides of the cross beam, holding it secure to the container.

Figure 3:
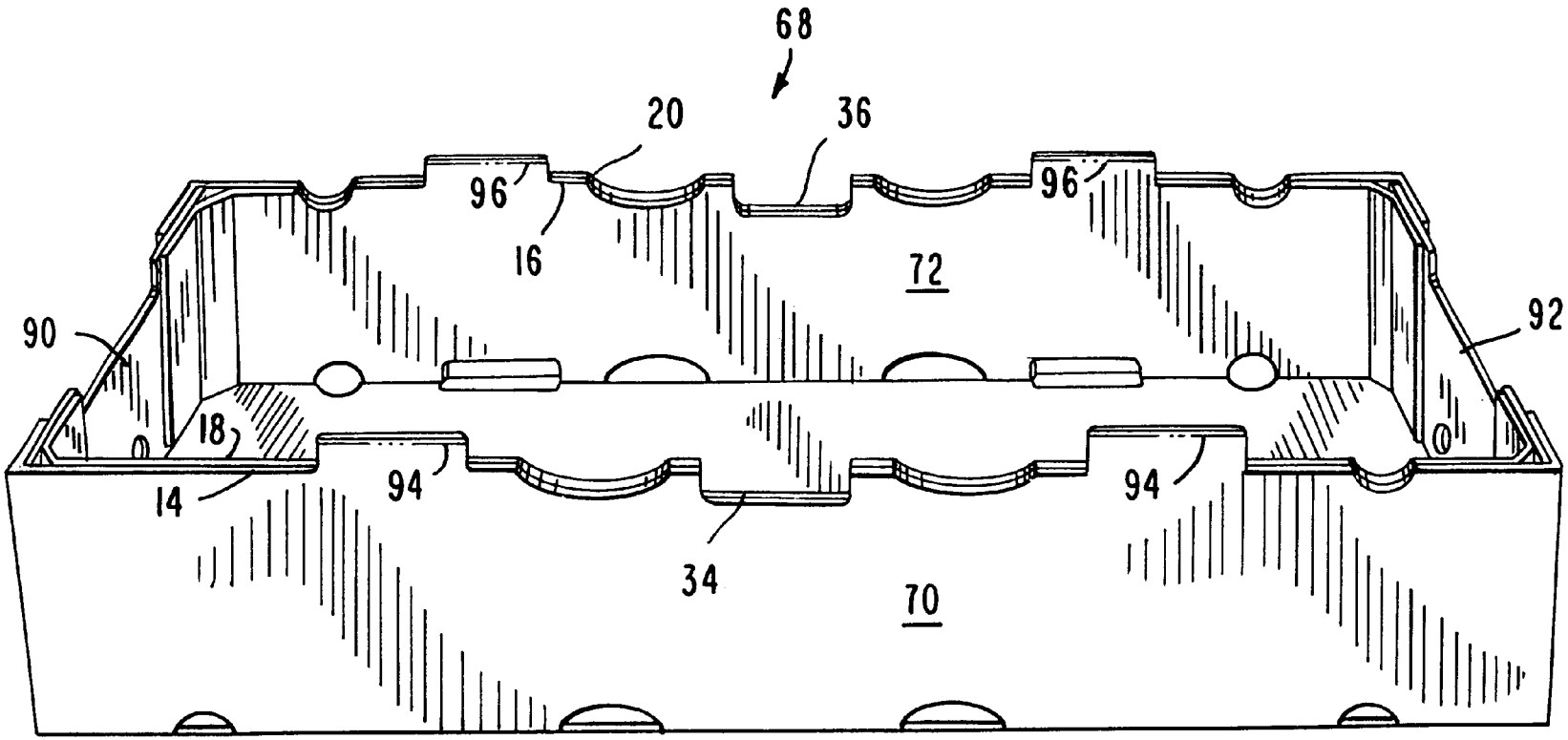
FIG. 3 is a perspective view of an erected container formed from the blank shown in FIG. 1.

FIG. 3 represents the container in its erected and folded form. After the container is fully folded, upper fold lines 64 and 66 become the top edge of the side wall. Extensions 94 and 96 extend upward from the top edge of the side wall, providing a device for securing a removable lid on top of the container.

Each end wall has a die cut recess cut from the top edge of the side wall created by removing or folding die cut panels 34 and 36 downward along their bottom edge. The recess is preferably a generally rectangular shape with slightly rounded edges. However, the recesses are optimally shaped to hold a cross beam securely and snugly without requiring an adhesive. As such, the exact shape of the recess can vary widely according to the shape of the cross beam. The panels 34 and 36 can either be removed entirely or remain as additional beam supports that laterally extend from the bottom of the recess towards the opposing recess.

Figure 6:
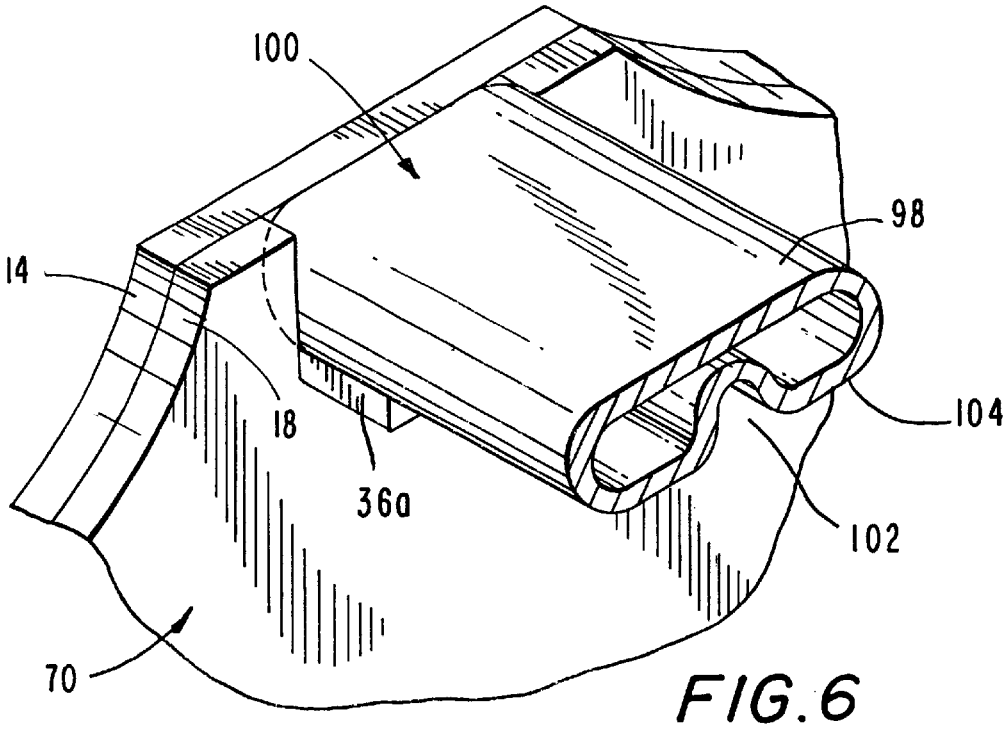
FIG. 6 is a perspective view of a container with partial die cut recesses.
Figure 7:
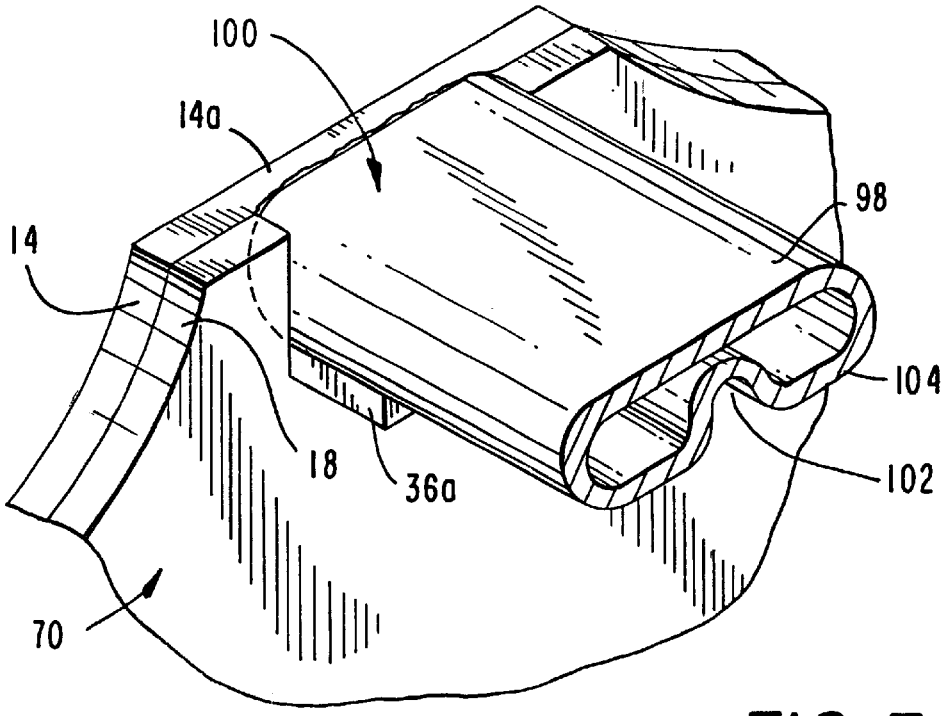
FIG. 7 is a perspective view of a container with partial die cut recesses and crushed areas.

In embodiments where the container blank has only a die cut recess on the interior panel, the erected container will only have a partial recess, that is to say, a recess on the inner portion of the side wall that does not extend entirely thought the thickness of the side wall, as depicted in FIG. 6. In contrast, in embodiments where the outer side panels have supplemental die cut recesses, the supplemental recesses border the die cut recesses of the interior flaps, creating combined recesses that extend fully through the thickness of the side wall, such as depicted in FIG. 3. As a middle ground, in embodiments where the container blank's outer side panels have crushed areas, the portions of the outer panel that borders the recesses will be compressed, resulting in combined recesses that extend most of the way, but not entirely, through the thickness of the side walls, as depicted in FIG. 7.

Figure 4:
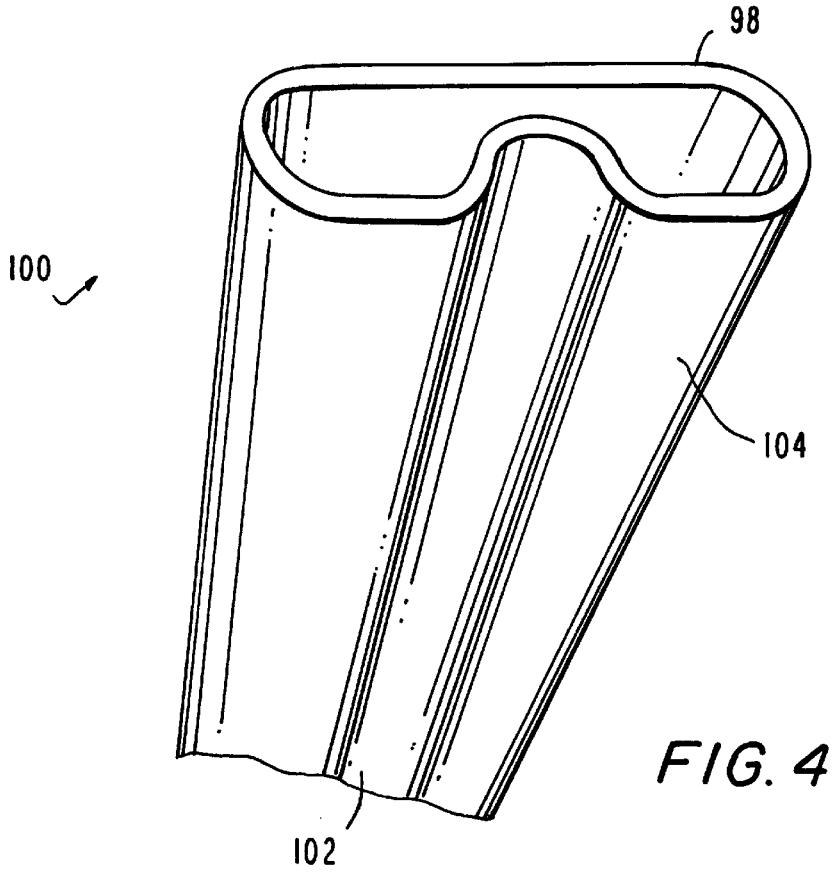
FIG. 4 is a bottom perspective view of a cross beam.

One embodiment of a cross beam is depicted in FIG. 4. Beam 100 is generally an oval shape made of a corrugated material, providing lightweight strength. Longitudinal impression 102 extends along the length of the underside of the beam 104 for additional strength. The top side 98 is substantially flat for contacting the inner surface of a removable lid. The width of beam 100 is preferably slightly less than that of the recess of the container to ensure a snug, non-bonded fit. However, the exact shape and width of the beam can vary greatly while maintaining the spirit of the invention. Further, the beam can be made of any material known in the art that is suitable being placed longitudinally across a container while supported by die cut recesses, such as wood, paper wound posts, plastic, metal or a composite material.

Figure 5:
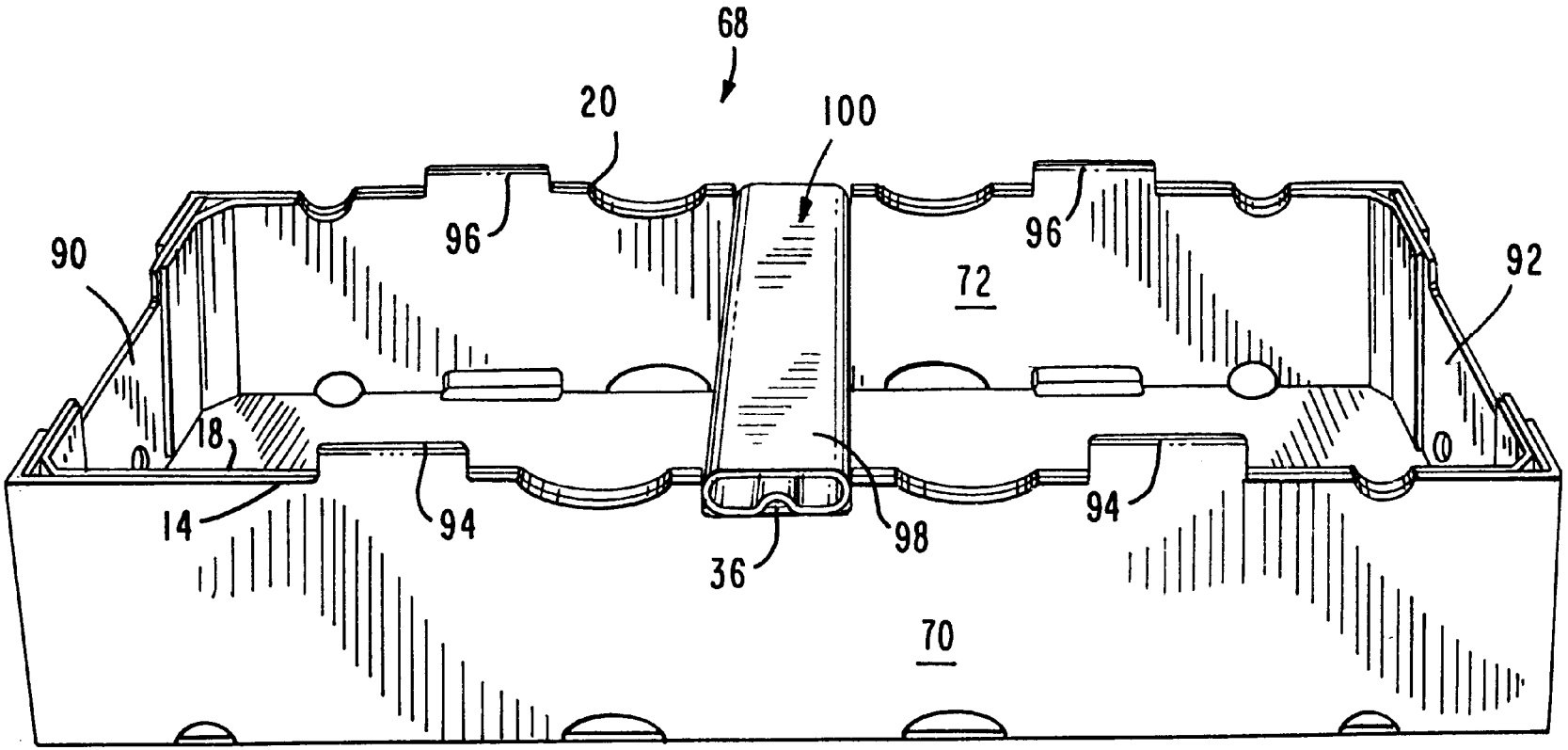
FIG. 5 is a perspective view of a beam supported by recesses in the container of FIG. 1.

Beam 100 can be supported by container 68 as depicted in FIG. 5. In this embodiment, the recesses extend entirely though the thickness of the side wall. The beam extends longitudinally across the width of the container and is supported by the recesses of the container. Further, although FIG. 5 shows the beam centrally located between end walls 90 and 92, the beam can be placed closer to one end wall or the other while maintaining the functionality of the invention. To accomplish this, the die cut recesses merely need to be cut from the side walls at a location other than the center. The beam can then extend from one recess to the other in a non-centered arrangement. Similarly, multiple beams can extend across the container, as long as multiple recesses are cut from the side walls. Further, cover flaps attached to the top edge of the outer panel (not shown) may fold and cover the end portions of the beam, holding it securely in place.

As stated above, in additional embodiments, the container may support the beam with a partial recess as shown in FIG. 6. The container has a die cut recess in the interior side panel 18, but no die cut recess in outer side panel 14. This creates a recess of a thickness less than the thickness of the combined side wall 70. As such, when the beam is placed across the container, it is supported only by a recess in the interior side wall. Further, the container may have an additional beam support 36*a* laterally connected to the bottom of the recess, formed by folding panel 36 downward without removing it. The additional beam support essentially extends the length of the recess inwardly, providing additional support.

As a result of the partial recess, the outer surface of the outer side wall is smooth and uncut, aesthetically hiding the fact that a beam is placed within the container and supported by the side walls. Further, outer panel 14 may have a crushed portion 14*a* that borders the recess. As stated above, the crushed portion is an area of the outer panel that is compressed, resulting in a thickness less than the non-crushed portions of the outer panel. The crushed area decreases the width of the outer panel, thereby increasing the thickness of the recess, providing more support for the beam. The partial recess is of a thickness equal the majority, but not all, of the thickness of the side wall, as depicted in FIG. 7. The crushed portion may be slightly compressed, as in FIG. 7, or more significantly pressed, such that the beam extends through a large majority of the side wall's thickness.

Figure 8:
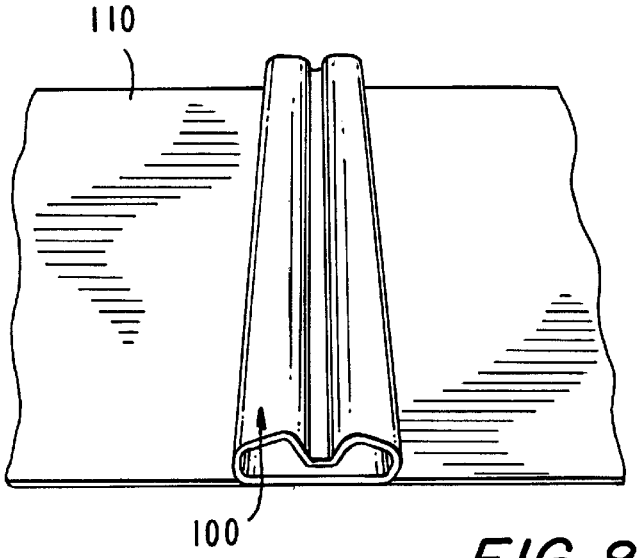
FIG. 8 is a bottom view of a beam bonded to a removable lid.
Figure 9:
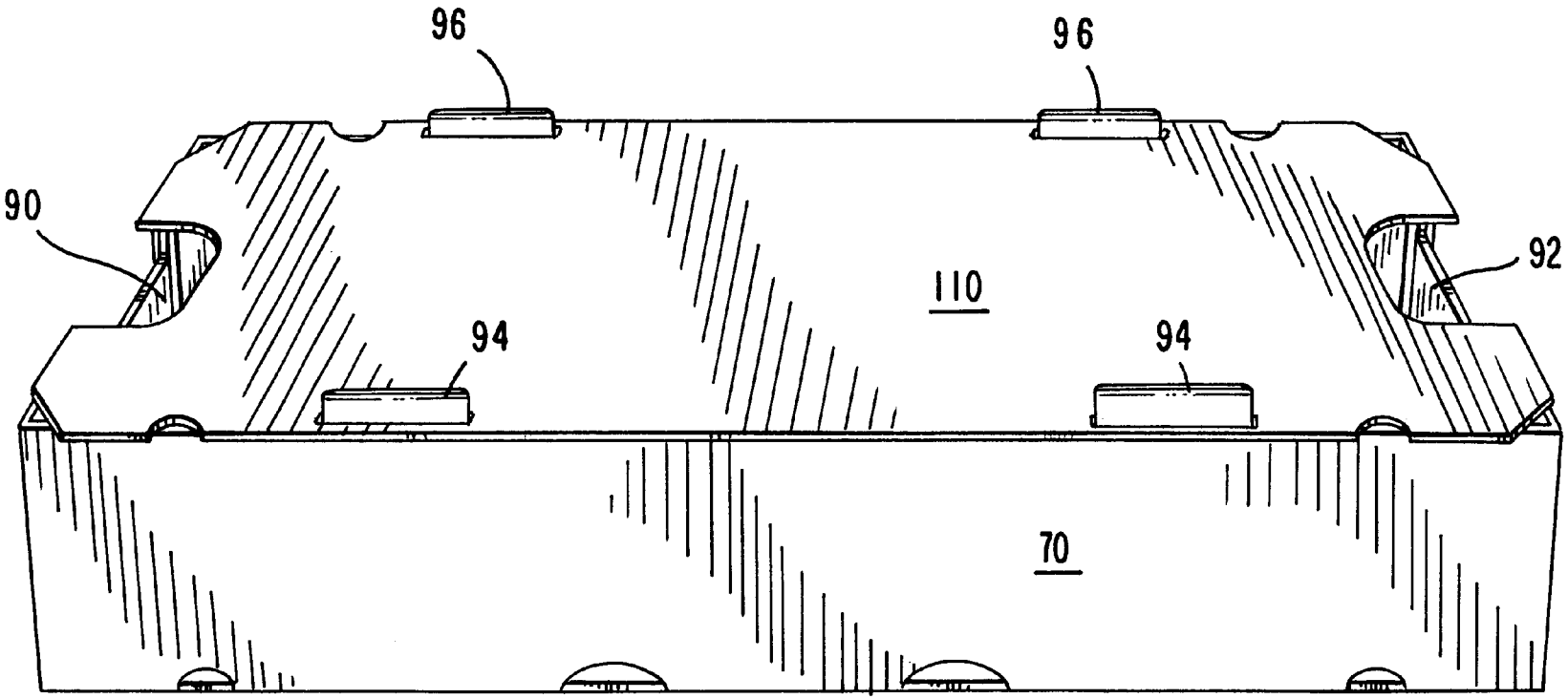
FIG. 9 is a perspective view of an erected container with a removable lid paced on top.

The beam may be bonded to the inner surface of lid 110 as shown in FIG. 8. The lid is inverted and placed upon the erected container depicted in FIG. 3. The beam fits into the recesses in the same manner as it does when it is not bonded to the lid, as shown in FIG. 9. The only difference is that the lid, in addition to the recesses, supports the beam.

Figure 10:
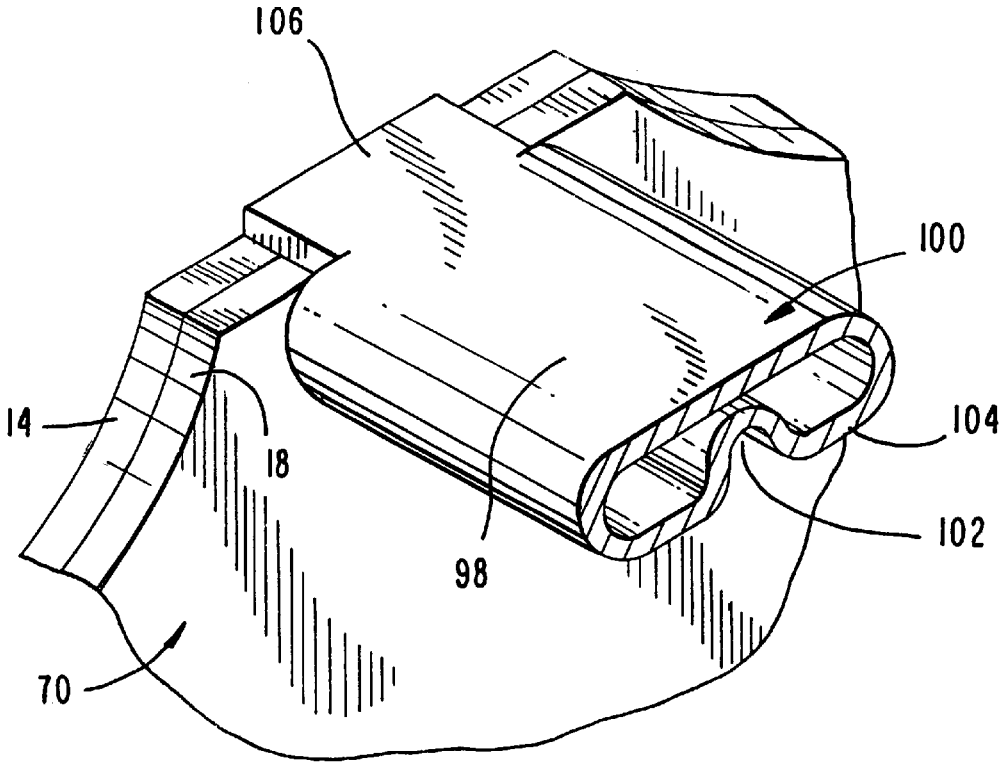
FIG. 10 is a side view of a beam with extensions supported by the side walls of an erected container.

FIG. 10 depicts an alternate embodiment of the invention, wherein the side walls are not required to have recesses. Instead, the beam extends longitudinally across the container and attaches to the side walls with extensions 106 on each end of the cross beam. The extensions are preferably thin pieces of material integrally attached to the beam with a top flat edge for contacting the flat inner surface of a lid. The extensions allow the beam to be supported by the side wall without necessitating die cut recesses.

Alternate embodiments of the invention include containers with multiple beams extending longitudinally across the top of the container. These containers may have multiple beams that fit into die cut recesses, or a combination thereof.

While the preferred embodiments of the invention has been illustrated and described, it will be appreciated that various changes can be made therein without departing from the spirit and scope of the invention.

We claim:

1. A container formed from a unitary blank having a base panel, first and second opposing side walls, and two opposing end walls, said first side wall including a first recess in a top surface thereof, and a beam supported by the first recess, said beam laterally extending between said first side wall and said second side wall, wherein said first side wall comprises a thickness and wherein said first recess comprises a thickness, wherein the thickness of said first recess is less than the thickness of said first side wall, and wherein said first side wall further includes a compressed area flush against said first recess.

2. A container according to claim 1, wherein said second side wall includes a second recess in a top surface thereof, said second side wall comprising a thickness and said second recess comprising a thickness, wherein the thickness of said second recess is less than the thickness of said second side wall.

3. A container according to claim 2, wherein said second side wall further includes a crushed area flush against said second recess.

4. A container according to claim 1, wherein said first recess further comprises a beam support extending laterally from the bottom of said first recess towards posing said second side wall.

5. The container according to claim 1, further comprising a first side flap foldably connected to said first side wall and a second side flap foldably connected to said second side walls, wherein said first side flap and said second side flaps each folds over the top of one end of said beam to hold said beam securely in place.

6. A container according to claim 1, further comprising a removable lid.

7. A container according to claim 6, wherein said beam is bonded to said lid.

8. The container disclosed in claim 1, wherein said beam comprises a material selected from a group consisting of: wood, corrugated paper, plastic, metal, paper wound posts, or a composite material.

9. A container formed from a unitary blank having a base panel, first and second opposing side walls, and two opposing end walls, said first side wall including a first recess in a top surface thereof, and a beam supported by the first recess, said beam laterally extending between said first side wall and said second side wall, wherein said first recess further comprises a beam support extending laterally from the bottom of said first recess towards said second side wall.

10. A container according to claim 9, wherein said first side wall comprises a thickness and wherein said first recess comprises a thickness, and wherein the thickness of said first recess is less than the thickness of said first side wall.

11. A container according to claim 9, wherein said first side wall further includes a compressed area flush against said first recess.

12. A container according to claim 9, further comprising a first side flap foldably connected to said first side wall and a second side flap foldably connected to said second side wall, wherein said first side flap and said second side flap each folds over the top of one end of said beam to hold said beam securely in place.

13. A container according to claim 9, further comprising a removable lid.

14. A container according to claim 13, wherein said beam is bonded to said lid.

15. A container according to claim 9, wherein said beam is constructed from a material selected from a group consisting of: wood, corrugated paper, plastic, metal, paper wound posts, or a composite material.

16. A container formed from a unitary blank having a base panel, first and second opposing side walls, and two opposing end walls, said first side wall including a first recess in a top surface thereof, and a beam supported by the first recess, further comprising a first side flap foldably connected to said first side wall and a second side flap foldably connected to said second side wall, wherein said first side flap and said second side flap each folds over the top of one end of said beam to hold said beam securely in place.

17. A container according to claim 16, wherein said first side wall comprises a thickness and wherein said first recess comprises a thickness, and wherein the thickness of said first recess is less than the thickness of said first side wall.

18. A container according to claim 16, wherein said first side wall further includes a compressed area flush against said first recess.

19. A container according to claim 16, further comprising a removable lid.

20. A container according to claim 19, wherein said beam is bonded to said lid.

21. A container according to claim 16, wherein said beam is constructed from a material selected from a group consisting of: wood, corrugated paper, plastic, metal, paper wound posts, or a composite material.

22. A container according to claim 16, wherein said first recess further comprises a beam support extending laterally from the bottom of said first recess towards said second side wall.

* * * * *